US010837390B2

(12) United States Patent
Kuempel et al.

(10) Patent No.: US 10,837,390 B2
(45) Date of Patent: Nov. 17, 2020

(54) METHOD FOR ASCERTAINING A SETPOINT VALUE FOR A MANIPULATED VARIABLE FOR ACTUATING A LOW-PRESSURE PUMP

(71) Applicant: Robert Bosch Gmbh, Stuttgart (DE)

(72) Inventors: Joerg Kuempel, Ludwigsburg (DE); Alexander Schenck Zu Schweinsberg, Moeglingen (DE); Burkhard Hiller, Oberriexingen (DE); Hans-Friedrich Schwarz, Muehlacker (DE); Klaus Joos, Walheim (DE); Michael Bauer, Gerlingen (DE); Werner Hess, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/084,485

(22) PCT Filed: Mar. 9, 2017

(86) PCT No.: PCT/EP2017/055512
§ 371 (c)(1),
(2) Date: Sep. 12, 2018

(87) PCT Pub. No.: WO2017/157750
PCT Pub. Date: Sep. 21, 2017

(65) Prior Publication Data

US 2019/0078529 A1 Mar. 14, 2019

(30) Foreign Application Priority Data

Mar. 17, 2016 (DE) ..... 10 2016 204 410

(51) Int. Cl.
*F02D 41/24* (2006.01)
*F02D 41/38* (2006.01)

(52) U.S. Cl.
CPC ..... *F02D 41/2464* (2013.01); *F02D 41/3854* (2013.01); *F02D 2200/0602* (2013.01); *F02D 2200/0606* (2013.01)

(58) Field of Classification Search
CPC ..... F02D 41/24; F02D 41/2464; F02D 41/38; F02D 41/3854; F02D 2200/0602; F02D 2200/0606
(Continued)

(56) References Cited

U.S. PATENT DOCUMENTS 6,253,734 B1 * 7/2001 Rembold ..... F02D 41/3845 123/446
6,708,671 B1 * 3/2004 Joos ..... F02D 41/1401 123/464
(Continued)

FOREIGN PATENT DOCUMENTS

DE 19548280 A1 6/1997
DE 102004062613 A1 7/2006
(Continued)

OTHER PUBLICATIONS

International Search Report for PCT/EP2017/055512, dated May 31, 2017.

*Primary Examiner* — John Kwon
*Assistant Examiner* — Johnny H Hoang
(74) *Attorney, Agent, or Firm* — Norton Rose Fulbright US LLP; Gerard Messina

(57) ABSTRACT

A method for ascertaining a setpoint value for a manipulated variable for the actuation of a low-pressure pump in a fuel-supply system for an internal combustion engine having a high-pressure accumulator and a high-pressure pump, the high-pressure pump being operated in a full delivery mode, and the low-pressure pump being actuated so that a pressure provided by the low-pressure pump is reduced, and the setpoint value at which a dip in a delivery quantity of the
(Continued)

high-pressure pump is detected is ascertained while taking into account an actuation value of the manipulated variable.

9 Claims, 4 Drawing Sheets

(58) Field of Classification Search
USPC ..... 701/101–103, 110, 114, 115; 123/445–448, 456, 495–497, 505, 123/516–519
See application file for complete search history.

(56) References Cited

U.S. PATENT DOCUMENTS 6,889,656 B1 * 5/2005 Rembold ..... F02D 41/062 123/446
8,483,932 B2 * 7/2013 Pursifull ..... F02D 33/003 123/446
9,217,406 B2 * 12/2015 Jung ..... F02D 41/062
9,453,466 B2 * 9/2016 Surnilla ..... F02M 37/04
9,617,960 B2 * 4/2017 Saito ..... F02D 41/3854
2002/0092503 A1 * 7/2002 Ricco ..... F02M 55/02 123/446
2002/0092505 A1 * 7/2002 Rembold ..... F02M 37/0052 123/464
2003/0089339 A1 * 5/2003 Schueler ..... F02M 59/06 123/446
2004/0211395 A1 * 10/2004 Greco ..... F02D 41/064 123/497
2006/0225706 A1 * 10/2006 Eser ..... F02D 41/3082 123/457
2010/0280742 A1 * 11/2010 Gwidt ..... F02D 41/22 701/103
2012/0215422 A1 * 8/2012 Sugiyama ..... F02D 41/3845 701/104
2017/0241367 A1 * 8/2017 Klesse ..... F02D 41/3845

FOREIGN PATENT DOCUMENTS

DE 102013220419 A1 4/2015
DE 102014214284 A1 1/2016

* cited by examiner

METHOD FOR ASCERTAINING A SETPOINT VALUE FOR A MANIPULATED VARIABLE FOR ACTUATING A LOW-PRESSURE PUMP

FIELD OF THE INVENTION

The present invention relates to a method for ascertaining a setpoint value for a manipulated variable for actuating a low-pressure pump, and to a processing unit and a computer program for its execution.

BACKGROUND INFORMATION

In modern motor vehicles equipped with internal combustion engines, one or more electrical fuel pumps is/are frequently used as low-pressure pumps in low-pressure fuel systems, i.e. in the low-pressure region of the fuel supply, in particular in the form of what is known as pre-supply pumps, with whose aid the fuel is conveyed from a fuel tank to a high-pressure pump.

This combines the advantages of a rapid availability on account of a pre-supply of fuel by an electrical fuel pump during the start with the advantages of the hydraulic efficiency of a high-pressure pump driven by the internal combustion engine. In addition, the fuel delivery is able to be carried out in a demand-based manner. As a rule, an electrical fuel pump requires its own open-loop control or closed-loop control and for this purpose is equipped with an electronics system that may be integrated into the fuel pump, for instance.

From the document DE 101 58 950 C2, for example, a method is discussed for operating a low-pressure pump for the supply of fuel to a high-pressure pump, via which the fuel is then in turn conveyed into a high-pressure accumulator. A pre-control value for a pressure provided by the low-pressure pump is adjusted, taking into account a pressure-temperature correlation and the occurrence of a cavitation in the high-pressure pump after the reduction of the pressure supplied by the low-pressure pump. Such a cavitation is detected on the basis of an instability of a pressure regulation for the high-pressure accumulator.

SUMMARY OF THE INVENTION

According to the present invention, a method for ascertaining a setpoint value for a manipulated variable for actuating a low-pressure pump, and also a processing unit and a computer program for its execution are provided, which have the features of the independent claims. Advantageous embodiments are the subject matter of the dependent claims and of the following description.

A method according to the present invention is used for ascertaining a setpoint value for a manipulated variable for actuating a low-pressure pump in a fuel-supply system for an internal combustion engine having a high-pressure accumulator and a high-pressure pump. Within the framework of the present invention, in particular a setpoint value for a manipulated variable for actuating a low-pressure pump is able to be ascertained such that a desired admission pressure is applied at the high-pressure pump. A desired admission pressure, by way of example, is characterized by being as low as possible and as high as required. A manipulated variable which may be used is an amplitude and/or a pulse-duty factor (e.g., for PWM) of an actuating current and/or an actuating voltage of an electric motor of the low-pressure pump.

The high-pressure pump is operated in a full delivery mode for this purpose. For example, the high-pressure pump may have a fuel-supply control valve to do so. A fuel-supply control valve is used to adjust the delivery quantity of the high-pressure pump. For a partial delivery, such as during a delivery phase, for example, the fuel-supply control valve may initially still be open in the direction of the low-pressure region so that fuel is still pushed back into the low-pressure region in the beginning, and fuel is then conveyed into the high-pressure accumulator via a suitable outlet valve only when the fuel-supply control valve is closed. For a full delivery, the fuel-supply control valve is already closed at the start of the delivery phase or when bottom dead center of an associated plunger of the high-pressure pump has been passed. A fuel-supply control valve that is closed in a currentless state or a fuel-supply control valve that is open in a currentless state may be used as the fuel-supply control valve. The difference is that in the latter case, a corresponding solenoid coil must be energized in order to allow for the closing of the valve, while in the former case, the valve is able to be closed when the solenoid coil is not energized.

The low-pressure pump is now actuated by varying the value of the manipulated variable in such a way that a pressure (admission pressure for the high-pressure pump) provided by the low-pressure pump is reduced. No ascertaining of the actual pressure is required for this purpose, but an actuating current, for example, or some other suitable manipulated variable may simply be reduced, which also reduces the pressure built up with the aid of the low-pressure pump, such as an electrical fuel pump, for instance. The reduction may be carried out in a continuous or in a step-by-step manner.

The setpoint value is now ascertained while taking into account an actuation value of the manipulated variable at which a dip in a delivery quantity of the high-pressure pump is detected. This allows for the ascertaining of a setpoint value for the manipulated variable at which the desired admission pressure is applied at the high-pressure pump without using a pressure sensor in the low-pressure region. In the process, not only is a high pressure provided that is sufficient to ensure no adverse effect on the desired delivery quantity of the high-pressure pump but also no unnecessary high pressure is built up that is not required to provide the desired delivery quantity of the high-pressure pump. The mentioned actuating value, for example, may then be used as the setpoint value, but it may be useful to add a suitable offset. This makes it possible for the low-pressure pump to supply a suitable pressure even without a closed-loop control, which would require a pressure sensor in the low-pressure region.

The proposed method also makes use of the fact that during a full delivery, the maximally possible delivery volume of the high-pressure pump is used to supply a specific delivery quantity, while during a regular operation of the high-pressure pump, only a partial delivery is normally used for which a correspondingly lower delivery volume is utilized. With an open fuel-supply control valve during a suction phase, vapor may form in the region of the fuel-supply control valve and in the delivery volume if the pressure of the fuel is low enough. This vapor is required in order to provoke a dip in the delivery quantity of the high-pressure pump. In the event of such a vapor buildup, the delivery volume of the high-pressure pump is not completely filled with fuel but also partially with vapor, which must first be compressed during the delivery phase and thereby causes a dip in the supply quantity. During a full delivery, the absolute portion of vapor in the delivery volume is thus increased to the maximum extent possible, so that the dip in the delivery quantity is able to be detected more easily, faster and more reliably.

Even the operating ranges in which the dip in the delivery quantity is provoked and is also able to be detected with sufficient accuracy are able to be considerably expanded in such a way. This pertains to wider rpm ranges and wider temperature ranges, for example. In addition, this allows for an ascertainment of a pre-control value at which the low-pressure pump is able to be operated at the lowest possible energy consumption and the lowest possible level of harmful emissions.

The dip in the delivery quantity of the high-pressure pump may be detected taking a change in a pressure increase in the high-pressure accumulator into account. A high pressure increase in the high-pressure accumulator is generated especially during a full delivery, but this depends on the delivery quantity. With a decreasing delivery quantity, the pressure increase in the high-pressure accumulator drops as well. A dip in the delivery quantity is therefore able to be detected in a very simple and precise manner on the basis of a change in the pressure increase in the high-pressure accumulator. The pressure increase can then be ascertained very easily, for example with the aid of a pressure sensor for detecting the pressure in the high-pressure accumulator.

For practical purposes, the change in the pressure increase in the high-pressure accumulator is detected based on a comparison of the pressure increase in the high-pressure accumulator with an associated increase in the reference pressure. The reference pressure increase may be a pressure increase as it occurs during a full delivery of the high-pressure pump and during a regular operation of the low-pressure pump.

By comparing a current pressure increase in the case of a full delivery during a reduction of the pressure supplied by the low-pressure pump, it is therefore very easy to detect a change in the pressure increase in the high-pressure accumulator.

The increase in the reference pressure may be ascertained during a full delivery of the high-pressure pump and prior to an actuation of the low-pressure pump for reducing the pressure. The reference pressure increase may particularly also be ascertained immediately prior to the start of the actuation of the low-pressure pump for reducing the pressure. This makes it possible to obtain the most current value possible for the increase in the reference pressure, which therefore allows for a very precise ascertainment of the setpoint value.

For practical purposes, a change in the pressure increase in the high-pressure accumulator is detected only if the pressure increase in the high-pressure accumulator deviates by more than a threshold value from the associated increase in the reference pressure. Possible measuring errors or other inaccuracies are able to be taken into account in this way.

In the extreme case, the delivery function of the high-pressure pump may also fail completely if the fuel-supply control valve is unable to be kept closed due to a buildup of vapor and an insufficient supply-chamber pressure as a result thereof. This is evaluated and processed as a dip in the supply quantity, in the same way as a pressure-value increase that differs from the reference pressure increase.

It is advantageous if pressure dips due to a fuel withdrawal for injections are taken into account in the change in the pressure increase in the high-pressure accumulator. For example, it may happen that during a full delivery of the high-pressure pump and the resultant pressure increase in the high-pressure accumulator, fuel is withdrawn from the high-pressure accumulator for the injection into the internal combustion engine. In the event that the magnitude of the pressure dip is known, such a pressure dip may then be deducted when ascertaining the pressure increase. However, it is also possible that the associated value of the pressure increase is not used. Such a pressure dip may occur both when ascertaining the reference pressure increase and when ascertaining a current pressure increase during the reduction of the pressure supplied by the low-pressure pump. In the former case, a reference-pressure increase that was erroneously measured as too low is able to be avoided, and in the latter case, a prematurely detected dip in the delivery quantity may be avoided.

In an advantageous manner, the present method is carried out for different fuel temperatures so that setpoint values for different fuel temperatures are ascertained. For example, the fuel temperature in the high-pressure pump is taken into account because the dip in the delivery function of the high-pressure pump is triggered there because of the vapor formation of the fuel. The fuel temperature in the high-pressure pump may be measured in the process or else also be estimated with the aid of a suitable fuel-temperature model. Ultimately, this makes it possible to actuate the low-pressure pump at any (user-defined) fuel temperature (e.g., by interpolation or extrapolation) using a suitable setpoint value for the manipulated variable, so that the desired admission pressure is applied at the high-pressure valve regardless of the fuel temperature.

It is also advantageous if the dip in the delivery quantity of the high-pressure pump is detected on the basis of a non-occurrence of a pressure increase in the high-pressure accumulator. A missing pressure increase means that the delivery is interrupted. The detection of a non-occurring pressure increase may take place within the framework of the mentioned change in the pressure increase, for example, i.e. in that it is detected that no further pressure increase is present, for instance. However, it is also possible that the missing pressure increase is detected in some other manner, such as within the scope of a check as to whether the delivery of the high-pressure pump has stopped. This constitutes another possibility for detecting the dip in the delivery quantity, which is a complete return to zero in this instance.

The high-pressure pump may be operated with the aid of a two-step control in a full delivery mode. Such a two-step control involves an operation of the high-pressure pump during which a full delivery is always carried out only in those instances where a setpoint pressure in the high-pressure accumulator is undershot, until this setpoint pressure or possibly another, slightly higher setpoint pressure is exceeded. Between two pressure increases, the pressure in the high-pressure accumulator is then slowly reduced by the withdrawal of fuel for the injection into the internal combustion engine. Such an operating mode is usually provided for a high-pressure pump anyway so that the proposed method is able to be carried out very easily and rapidly.

A processing unit according to the present invention, e.g., a control unit of a motor vehicle, is provided, in particular in terms of program technology, to carry out a method according to the present invention.

The implementation of the present method in the form of a computer program is also advantageous because it causes especially little expense, in particular if an executing control unit is also used for other tasks and is therefore provided anyway. Suitable data carriers for providing the computer program in particular are magnetic, optical and electrical memories, such as hard disks, flash memories, EEPROMs, DVDs and others, for example. A download of a program via computer networks (internet, intranet etc.) is possible as well.

Additional advantages and developments of the present invention result from the description and the appended drawing.

The present invention is schematically shown in the drawing on the basis of an exemplary embodiment and will be described in the following text with reference to the drawings.

DETAILED DESCRIPTION

Figure 1:
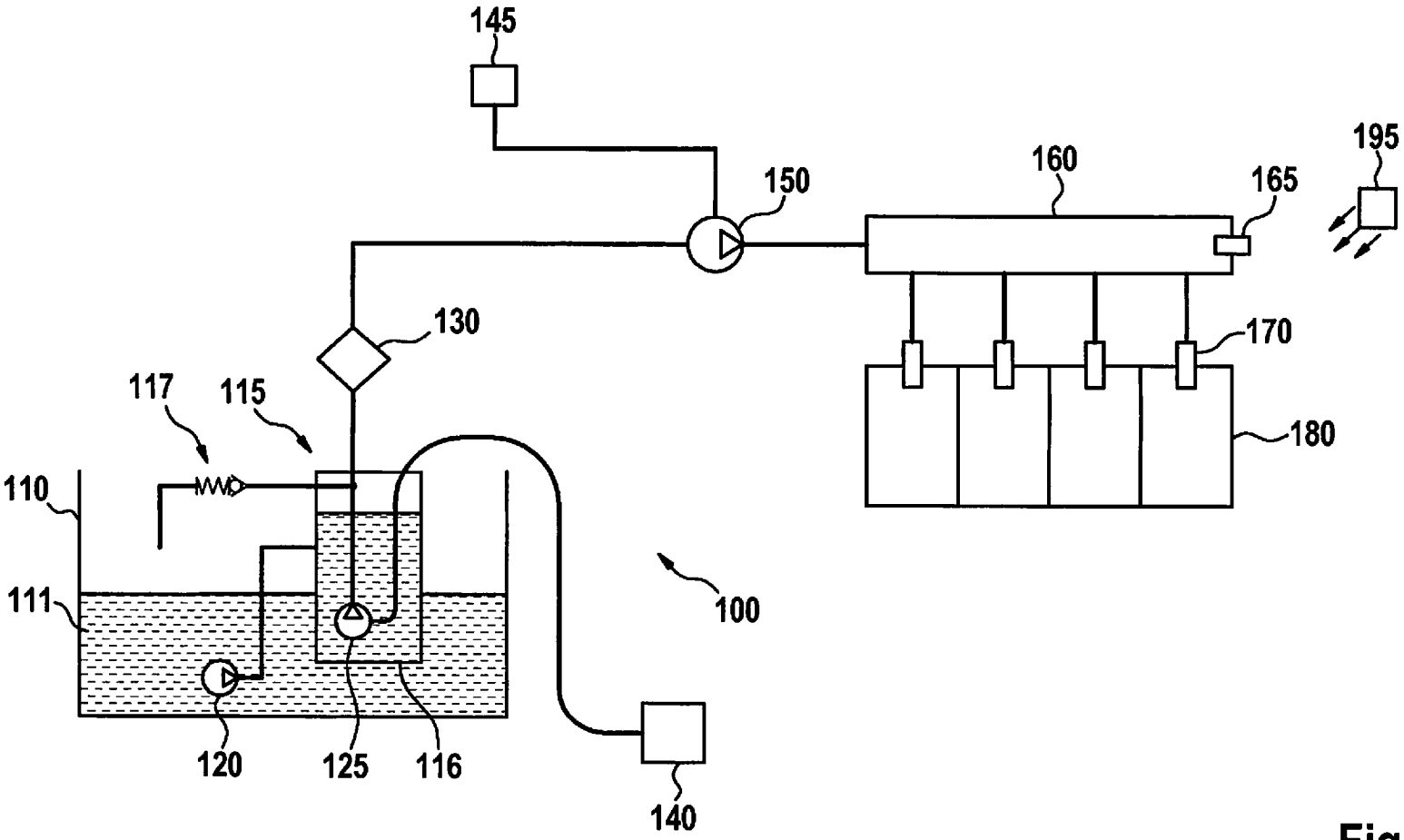
FIG. 1 shows schematically, a fuel-supply system for an internal combustion engine, which may be used for a method according to the present invention.

FIG. 1 schematically shows a fuel-supply system 100 for an internal combustion engine 180, which may be used for a method according to the present invention.

Fuel-supply system 100 includes a fuel tank 110, which is filled with fuel 111. An in-tank unit 115, which in turn has a pre-delivery cup 116 in which a low-pressure pump 125, e.g., in the form of an electrical fuel pump, is disposed, is situated inside fuel tank 110.

Pre-delivery cup 116 is able to be filled with fuel from fuel tank 110 via a suction-jet pump 120 (or possibly also a plurality of suction-jet pumps) disposed in fuel tank 110 outside the pre-delivery cup. Electrical fuel pump 125 may be actuated with the aid of a processing unit 140, which is configured as a pump-control unit in this instance, so that fuel is conveyed from pre-delivery cup 116, via a filter 130, to a high-pressure pump 150.

Figure 2:
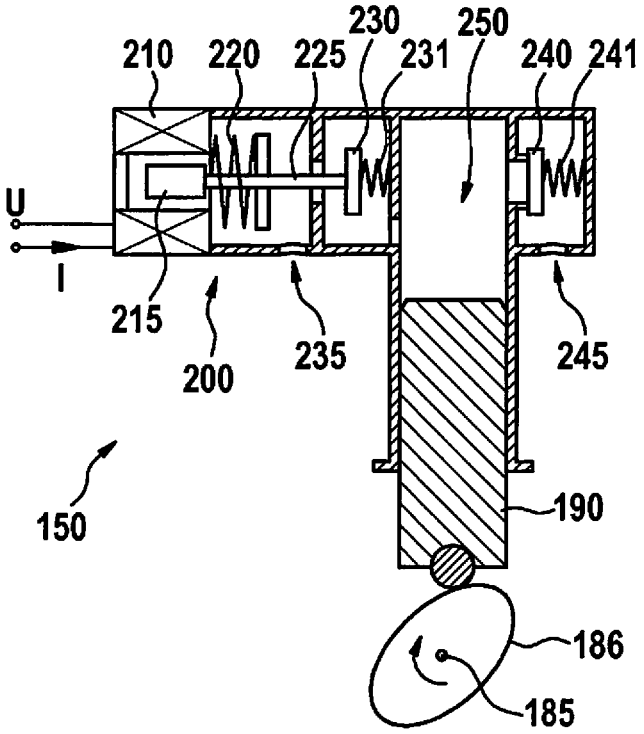
FIG. 2 shows schematically, a high-pressure pump having a fuel-supply control valve.

For a more detailed description of high-pressure pump 150, which is actuated via a processing unit 145 that is configured as a further pump-control unit in this case, reference is made to FIG. 2. In addition, a pressure-limiting valve 117 is provided in the low-pressure line.

As a rule, high-pressure pump 150 is driven via internal combustion engine 180 or its camshaft. From high-pressure pump 150, the fuel is then conveyed into a high-pressure accumulator 160 by which the fuel is able to be supplied to internal combustion engine 180 via fuel injectors 170. In addition, a pressure sensor 165 by which a pressure in the high-pressure accumulator is able to be detected is provided on high-pressure accumulator 160.

An actuation of internal combustion engine 180 or of fuel injectors 170 may be carried out with the aid of an engine-control unit 195 that differs from the pump-control units 140 and 145, the control units then being able to communicate with one another. However, it is also conceivable to use a shared control unit.

FIG. 2 schematically shows a high-pressure pump 150 including a fuel-supply control valve 200 in greater detail than in FIG. 1. High-pressure pump 150 has a plunger 190, which is moved up and down via a cam 186 on a camshaft 185 of the internal combustion engine. A delivery volume 250 is reduced or enlarged in this manner.

Fuel-supply control valve 200 has an inlet opening 235, via which fuel supplied by the low-pressure pump is able to reach delivery volume 250. With the aid of an inlet valve 230 having a recoil spring 231, which is part of the fuel-supply control valve 200, an opening downstream from inlet opening 235 is able to be sealed.

In addition, a solenoid coil 210 is provided, which may be part of an electromagnet, which is able to be supplied with a voltage U and energized using a current I. Voltage U and current I may be provided via corresponding pump-control unit 145, for example.

Furthermore, a spring 220 is shown, which pushes a bolt 225, on whose end facing the solenoid coil a magneto armature 215 is attached, in the direction of inlet valve 230. Without an energization of solenoid coil 210, inlet valve 230 is therefore permanently kept open. In other words, it is a fuel-supply control valve that is open in a deenergized state. It should be noted in this context that the spring force of spring 220 is greater than that of recoil spring 231.

If solenoid coil 210 is now energized by a current of sufficient strength, then bolt 225 is moved counter to spring 220 with the aid of magneto armature 215. In this way, inlet valve 230 is closed by recoil spring 231 but is able to be opened by an application of pressure.

In addition, an outlet valve 240 having a recoil spring 241 is provided via which fuel is able to be conveyed from delivery volume 250 via an outlet opening 245 to the high-pressure accumulator.

Figure 3:
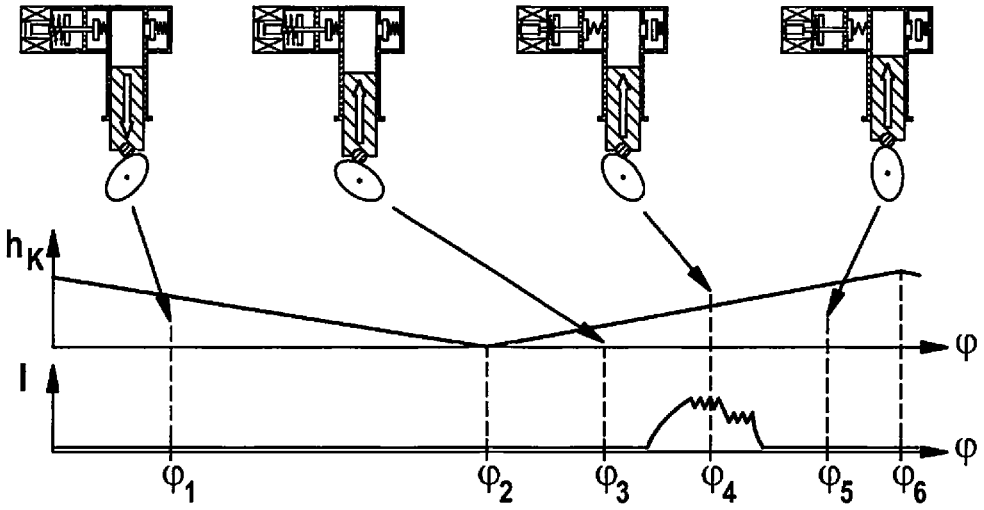
FIG. 3 shows characteristics of a lift of a plunger of the high-pressure pump and a current of an associated fuel-supply control valve during an operation of the high-pressure pump in a partial delivery mode.

FIG. 3 shows characteristics of a lift $h_k$ of the plunger of the high-pressure pump and of current I of the associated fuel-supply control valve during an operation of the high-pressure pump in a partial delivery mode, plotted over a camshaft angle or angle $\varphi$ in each case. In addition, the high-pressure pump including a fuel-supply control valve as it was described in greater detail with reference to FIG. 2, is shown for different angles in a respective position.

To begin with, the plunger of the high-pressure pump is in a downward movement because of the rotation of the cam, as illustrated by the position of the high-pressure pump for angle $\varphi_1$ by way of example. This is a suction phase, i.e. fuel provided by the low-pressure pump is suctioned into the delivery volume of the high-pressure pump. The fuel-supply control valve is not energized for this purpose and is thus permanently open. This allows fuel to flow into the delivery volume without obstruction. The outlet valve is closed in this case.

At angle $\varphi_2$, bottom dead center of the plunger is reached and the suction phase is concluded. The plunger subsequently moves back up again in the direction of top dead center, as illustrated by way of example by the position of the high-pressure pump for angle $\varphi_3$. The fuel-supply control valve is still permanently open in this case, which means that fuel from the delivery volume is initially pressed back into the low-pressure region again by way of the inlet opening.

Only during the upward movement of the plunger is the solenoid coil energized by a current I so that the magneto armature having the bolt releases the inlet valve and the inlet valve is able to close, as illustrated by way of example by the position of the high-pressure pump for angle $\varphi_4$. As can be seen in the region around angle $\varphi_4$, the current may initially include a pickup current and then a slightly lower holding current so that the magneto armature is still able to be kept pulled up after the pickup.

As soon as the fuel-supply control valve or the inlet valve is able to close, the fuel from the delivery volume is then no longer conveyed back into the low-pressure region but conveyed into the high-pressure accumulator via the outlet valve and the outlet opening, as illustrated by way of example by the position of the high-pressure pump for the angle $\varphi_5$. The delivery comes to an end only when the plunger reaches top dead center at the angle $\varphi_6$.

In this context it should be noted that current I is able to be reduced even before top dead center is reached since the inlet valve also remains closed counter to the opening force of the spring due to the high pressure in the delivery volume. By a suitable selection of the instant or the corresponding angle at which the fuel-supply control valve is closed, the delivery quantity, and thus the pressure buildup in the high-pressure accumulator, is able to be adjusted or controlled.

Figure 4:
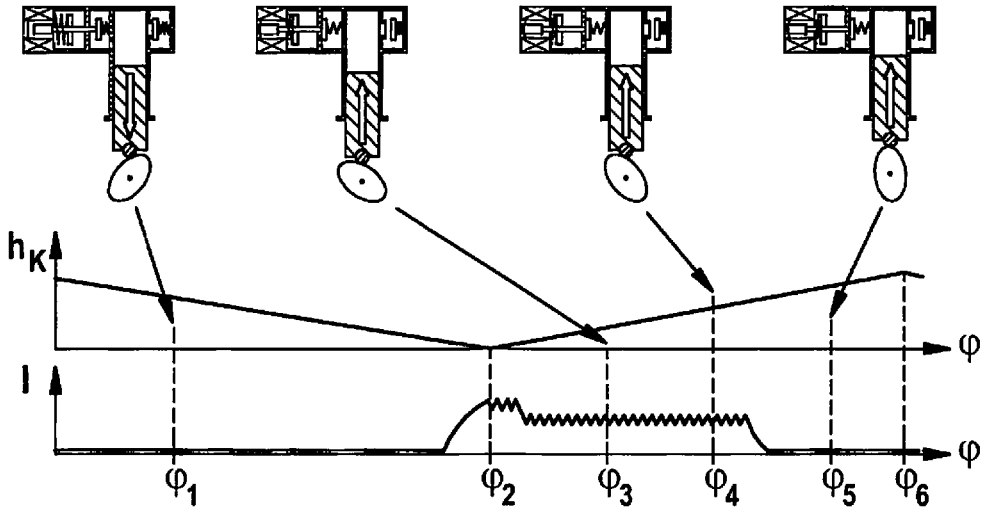
FIG. 4 shows characteristics of a lift of a plunger of the high-pressure pump and a current of an associated fuel-supply control valve during an operation of the high-pressure pump in a full delivery mode.

Characteristics of a lift $h_k$ of the plunger of the high-pressure pump and current I of the associated fuel-supply control valve during an operation of the high-pressure pump in a full delivery mode are shown in FIG. 4 over a camshaft angle, or angle $\varphi$ in each case.

In addition, the high-pressure pump including a fuel-supply control valve as it was described in greater detail with reference to FIG. 2, is shown for different angles in a respective position. The characteristic corresponds to that which is shown in FIG. 3 but with the difference that the actuation current, which sets in shortly before angle $\varphi_4$ according to FIG. 3, already sets in shortly before angle $\varphi_2$ in this case, i.e. shortly before the plunger of the high-pressure pump reaches bottom dead center.

This has the result that the delivery phase already begins as soon as bottom dead center is exceeded or immediately thereafter. This may exemplarily also be gathered from the corresponding position of the fuel-supply control valve at angle $\varphi_3$, which is closed here—in contrast to FIG. 3. In other words, a full delivery of the high-pressure pump is achieved in this way.

Figure 5:
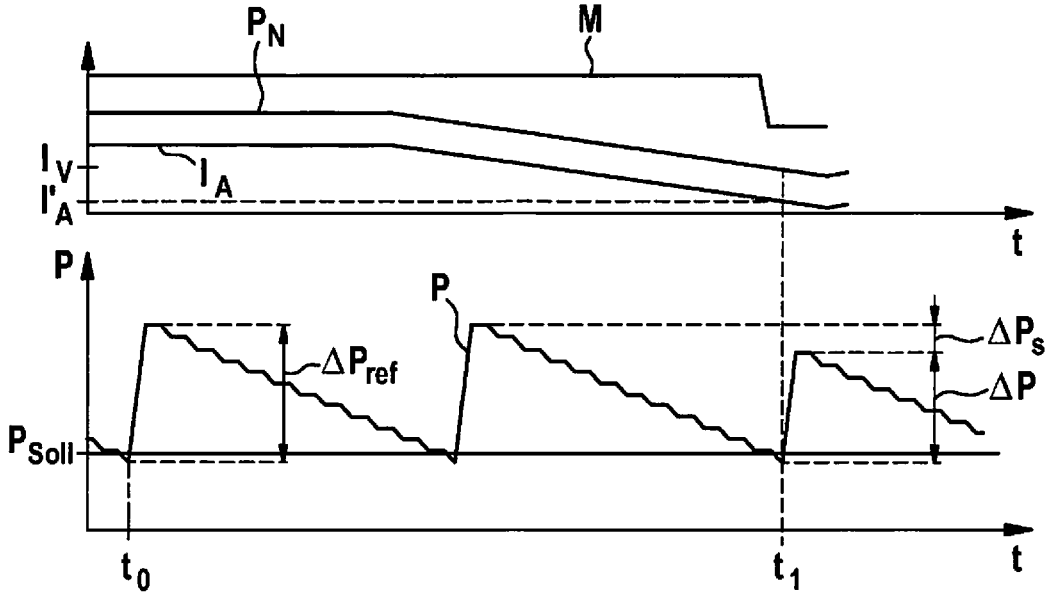
FIG. 5 shows a pressure characteristic in a high-pressure accumulator as well as characteristics of further quantities in a method according to the present invention in a specific embodiment.

In FIG. 5, a pressure characteristic in a high-pressure accumulator in a method according to the present invention is shown in a preferred specific embodiment in a lower diagram. A pressure P has been plotted over a time t for this purpose. A characteristic of additional quantities in a method according to the present invention in a specific embodiment is shown in schematized form in an upper diagram. The quantities include a manipulated variable of the low-pressure pump, in this instance an actuation current $I_A$, an associated pressure $P_N$ provided by the low-pressure pump, as well as a delivery quantity M of the high-pressure pump, plotted over time t in each case.

Figure 6:
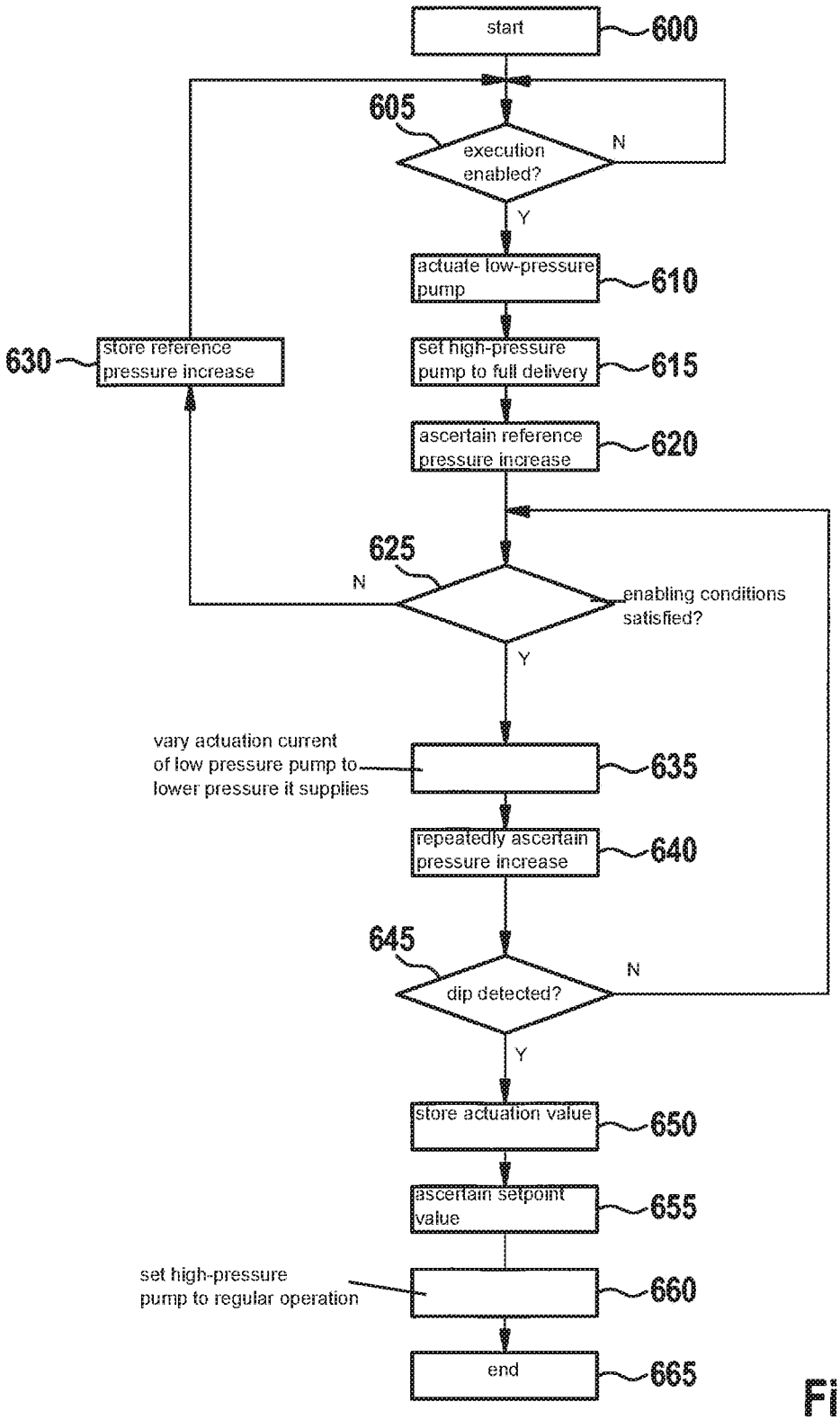
FIG. 6 shows schematically, a sequence of a method according to the present invention in a specific embodiment.

FIG. 6 schematically shows a sequence of a method according to the present invention in a specific embodiment, which will be described in the following text also with reference to FIG. 5.

Following the start of the present method in step 600, it may first be checked in a step 605 whether the execution of the ascertainment of the setpoint value is enabled. In this context, a current rotational frequency of the internal combustion engine, a temperature of the internal combustion engine and/or the high-pressure pump and/or the fuel, as well as a current driving state of an associated motor vehicle, for example, are conceivable as enabling conditions.

While in the latter case, it may be ensured that the steadiest possible operation of the internal combustion engine is occurring, attention should be paid in connection with the remaining variables to make sure that certain threshold values are observed so that the mentioned vapor formation in the delivery volume of the high-pressure pump does not precisely take place just then because the reference pressure increase must first be ascertained.

If no enabling is present, then the check of the enabling may be carried out anew, possibly following a specific period of time. In the case of enabling, a suitable actuation of the low-pressure pump may be carried out in a step 610 so that a sufficiently high pressure is made available. A suitable actuation value for the manipulated variable may be ascertained with the aid of a table, for example, or the actuation value from a previous execution of the present method may be used, e.g., also in the event of a termination of the method.

According to a step 615, the high-pressure pump may subsequently be set to a full delivery with the aid of the mentioned two-step control. An associated characteristic of pressure P in the high-pressure accumulator is shown in FIG. 5 by way of example.

As soon as pressure P drops below a setpoint value $P_{setpoint}$ for the pressure in the high-pressure accumulator, the high-pressure pump is actuated in a full delivery mode. Pressure P in the high-pressure accumulator rises considerably in the process. One rotation of the high-pressure pump may already be sufficient for raising pressure P considerably beyond setpoint value $P_{setpoint}$. Because of the withdrawal of fuel for injections, the pressure subsequently slowly drops again.

According to step 620, a reference pressure increase is now able to be ascertained as illustrated here in FIG. 5 at instant $t_0$. This reference pressure increase, which is denoted by $\Delta P_{ref}$, corresponds to a pressure increase as it is reached when the low-pressure pump supplies a sufficiently high pressure, i.e. at the maximally possible delivery quantity of the high-pressure pump. The reference pressure increase is able to be ascertained in that a value prior to and a value following the pressure increase are detected with the aid of the pressure sensor and their difference is formed.

This sufficiently high pressure $P_N$ of the low-pressure pump, for example, may be achieved by a suitable actuation value of the manipulated variable, e.g., an actuation current $I_A$. Delivery quantity M of the high-pressure pump then lies at its maximum value.

In a step 625, another check with regard to the enabling conditions may then be carried out. In the event that these enabling conditions are no longer satisfied, the current status of the method, such as the reference pressure increase, for example, may be stored according to a step 630 and a return to before step 605 may take place.

If the enabling conditions continue to be present, then according to a step 635, the low-pressure pump may be started to reduce the pressure it supplies. To do so, actuation current $I_A$ may be varied in a suitable manner, in particular reduced. For example, this may be done continually, in particular in a linear or a ramp-type manner, or else also in a step-by-step manner. Pressure $P_N$ provided in this way also decreases accordingly but need not be measured. Delivery quantity M still remains constant for the time being.

According to a step 640, the pressure increase may now be ascertained repeatedly. This may be done in the same way as for the reference pressure increase. It should be noted that a check of the enabling conditions according to step 625 may also be repeated again and again during the repeated ascertainments of the current pressure increase, which may possibly also lead to an abortion of the present method.

As soon as a dip in delivery quantity M is detected according to step 645, the reducing of the pressure of the low-pressure pump may be stopped and especially also be adjusted again to a higher or to the initial value.

A detection of the dip in the delivery quantity is shown in FIG. 5 by way of example at instant ti. The current pressure increase, here denoted by ΔP, is lower than reference pressure increase $\Delta P_{ref}$ at this point in time, i.e. by at least a threshold value $\Delta P_s$. As already mentioned, a dip in delivery quantity M of the high-pressure pump is able to be detected in this manner. In addition, a dip in the delivery quantity may also be registered if no pressure increase ΔP whatsoever is detected after the high-pressure pump is actuated. This therefore constitutes the extreme case of a dip in the delivery quantity.

In a step 650, it is now possible to store the actuation value $I'_A$ for the manipulated variable, and in a step 655, a suitable setpoint value $I_v$ for the manipulated variable is able to be ascertained and stored while taking the current actuation value $I'_A$ into account. A suitable offset, for example, may simply be added for this purpose.

According to a step 660, the operation of the high-pressure pump may be readjusted from the full delivery mode to a regular operation so that the present method is concluded according to a step 665.

Setpoint values for different fuel temperatures may be ascertained in the developed high-pressure pump so that a suitable setpoint value for the manipulated variable, in this case, the actuation current, is able to be used for each fuel temperature (e.g., by interpolation or extrapolation) with the result that a desired admission pressure is applied at the high-pressure pump. A desired admission pressure is characterized particularly by being as low as possible and as high as required.

What is claimed is:

1. A method for ascertaining a setpoint value for a manipulated variable for actuating a low-pressure pump in a fuel-supply system for an internal combustion engine having a high-pressure accumulator and a high-pressure pump, the method comprising:

operating the high-pressure pump in a full delivery mode;

controlling the low-pressure pump by varying, over a plurality of fuel injections, the manipulated variable so that a pressure supplied by the low-pressure pump is reduced;

detecting, using a sensor which detects a pressure in the high-pressure accumulator, a dip in fuel quantity delivered by the high-pressure pump to the high-pressure accumulator, the detecting including:

sensing, for each of the fuel injections, a respective pressure increase in the high-pressure accumulator; and detecting, for one of the fuel injections, the dip in the fuel quantity delivered by the high-pressure pump when the respective pressure increase for the one of the fuel injections is less than a reference pressure increase; and ascertaining the setpoint value taking into account an actuation value of the manipulated variable at which the detected dip in the fuel quantity delivered by the high-pressure pump to the high-pressure accumulator is detected.

2. The method of claim 1, wherein the dip in the fuel quantity delivered is detected based on a comparison of the respective pressure increase in the high-pressure accumulator with the reference pressure increase.

3. The method of claim 2, wherein the reference pressure increase is ascertained during a full delivery of the high-pressure pump and prior to an actuation of the low-pressure pump for reducing the pressure.

4. The method of claim 1, wherein the dip in the fuel quantity of the high-pressure pump is detected based on a missing pressure increase in the high-pressure accumulator after the high-pressure pump is actuated.

5. The method of claim 1, wherein during the operating, the high-pressure pump is operated in the full delivery mode using a two-step control.

6. The method of claim 1, wherein the low-pressure pump is actuated using the ascertained setpoint value for the manipulated variable.

7. The method of claim 1, wherein the setpoint value is ascertained as a function of a fuel temperature.

8. A processing unit, comprising:

a processing device for ascertaining a setpoint value for a manipulated variable for actuating a low-pressure pump in a fuel-supply system for an internal combustion engine having a high-pressure accumulator and a high-pressure pump, by performing the following:

operating the high-pressure pump in a full delivery mode;

controlling the low-pressure pump by varying, over a plurality of fuel injections, the manipulated variable so that a pressure supplied by the low-pressure pump is reduced;

detecting, using a sensor which detects a pressure in the high-pressure accumulator, a dip in fuel quantity delivered by the high-pressure pump to the high-pressure accumulator, the detecting including:

sensing, for each of the fuel injections, a respective pressure increase in the high-pressure accumulator; and detecting, for one of the fuel injections, the dip in the fuel quantity delivered by the high-pressure pump when the respective pressure increase for the one of the fuel injections is less than a reference pressure increase; and ascertaining the setpoint value taking into account an actuation value of the manipulated variable at which the detected dip in the fuel quantity delivered by the high-pressure pump to the high-pressure accumulator is detected.

9. A non-transitory computer readable medium having a computer program, which is executable by a processor, comprising:

a program code arrangement having program code for ascertaining a setpoint value for a manipulated variable for actuating a low-pressure pump in a fuel-supply system for an internal combustion engine having a high-pressure accumulator and a high-pressure pump, the program code, when executed by the processor, causing the processor to perform the following:

operating, via the processor, the high-pressure pump in a full delivery mode;

controlling, via the processor, the low-pressure pump by varying, over a plurality of fuel injections, the manipulated variable so that a pressure supplied by the low-pressure pump is reduced;

detecting, using a sensor which detects a pressure in the high-pressure accumulator, a dip in fuel quantity delivered by the high-pressure pump to the high-pressure accumulator, the detecting including:

sensing, for each of the fuel injections, a respective pressure increase in the high-pressure accumulator; and detecting, for one of the fuel injections, the dip in the fuel quantity delivered by the high-pressure pump when the respective pressure increase for the one of the fuel injections is less than a reference pressure increase; and ascertaining, via the processor, the setpoint value taking into account an actuation value of the manipulated variable at which the detected dip in the fuel quantity delivered by the high-pressure pump to the high-pressure accumulator is detected.

* * * * *